United States Patent [19]

Hinchcliffe et al.

[11] 4,273,233

[45] Jun. 16, 1981

[54] APPARATUS FOR CONVEYING ROD-LIKE ARTICLES

[75] Inventors: Dennis Hinchcliffe; George R. Bennett; Frank Heybourn, all of London, England

[73] Assignee: Molins, Limited, London, England

[21] Appl. No.: 955,539

[22] Filed: Oct. 30, 1978

[30] Foreign Application Priority Data

Nov. 1, 1977 [GB] United Kingdom ..... 45452/77

[51] Int. Cl.[3] ..... B65G 1/04

[52] U.S. Cl. ..... 198/347; 198/573

[58] Field of Search ..... 198/347, 436, 437, 456, 198/572, 573; 131/21 R, 21 A, 21 B

[56] References Cited

U.S. PATENT DOCUMENTS

| | | | |
|---|---|---|---|
| 3,305,128 | 2/1967 | Dearsley | 198/347 X |
| 3,650,371 | 3/1972 | Constable et al. | 198/347 |
| 3,998,319 | 12/1976 | Mernoe | 198/347 |
| 4,078,648 | 3/1978 | Hinchcliffe et al. | 198/347 |
| 4,099,608 | 7/1978 | McCombie | 198/347 |
| 4,120,391 | 10/1978 | Molins et al. | 198/347 |

FOREIGN PATENT DOCUMENTS

| | | | |
|---|---|---|---|
| 2500526 | 9/1975 | Fed. Rep. of Germany | 198/347 |
| 2504264 | 8/1976 | Fed. Rep. of Germany | 198/347 |
| 1389447 | 4/1975 | United Kingdom | 198/347 |

*Primary Examiner*—James L. Rowland
*Attorney, Agent, or Firm*—Craig and Antonelli

[57] ABSTRACT

Apparatus for conveying rod-like articles transverse to their lengths includes a first conveyor for moving a stack of articles from an inlet to an outlet and a reversible second conveyor connected to the first conveyor at a junction. The first and second conveyors each comprise interconnected horizontal path sections, which respectively lie alongside one another. The stack passing through the inlet may be delivered from a filter rod producing machine, and that passing through outlet may be delivered to a filter cigarette making machine. In this case the first conveyor constitutes a delay line to allow curing of the filter rods, and the second conveyor forms a reversible reservoir to adjust the net flow at the junction under control of a sensor.

22 Claims, 8 Drawing Figures

APPARATUS FOR CONVEYING ROD-LIKE ARTICLES

This invention relates to apparatus for conveying rod-like articles such as cigarettes or filter rods.

In the production of filter cigarettes it is convenient to convey filter rods automatically from a filter rod making machine to a machine for uniting filter rod portions to tobacco lengths. It is already known to provide a conveyor system for moving filter rods in stack formation from a filter rod making machine to a filter cigarette assembling machine, or to a pneumatic distributing system connected to several such assembling machines.

Some filter rods, such as those including cellulose acetate, require a curing or hardening time, which may vary from 15 minutes to several hours, after production to allow plasticisers to set or dry before the rods can be handled in an assembling machine or a pneumatic distributor. When the required curing time is not too long it is possible to provide sufficient curing while conveying the rods from the filter rod making machine, by extending the length of the conveyor system for example. Such an extended conveyor path is commonly called a delay line. The delay line is often associated with a reversible reservoir so that temporary fluctuations in the supply of and demand for rods need not require stopping of the machines served by the conveyor system.

The present invention is concerned with apparatus which may be used as a conveyor system including a delay line and reversible reservoir. Accordingly, the invention provides apparatus for conveying rod-like articles including first conveyor means for moving a stack of rod-like articles from an inlet to an outlet, and second conveyor means for moving a stack of rod-like articles to and from a junction with the first conveyor means, the first and second conveyor means respectively including first and second paths which are generally horizontally spaced. The first and second paths need not be in the same horizontal plane. In a preferred form the first path includes a plurality of interconnected substantially horizontal paths lying one above the other. The second path may be in similar form. Preferably at least part of the first path and at least part of the second path lie in horizontally-spaced vertical planes.

The first and second paths are preferably connected by parts of the first and/or second conveyor means which extend laterally (including diagonally) between the paths. The junction may be located on or adjacent this connecting part. Similarly, the inlet or outlet may be on or associated with the connecting path. The junction may conveniently be adjacent the inlet or outlet. The inlet and outlet may merely be opposite ends of the first conveyor means.

The second conveyor means preferably includes a reversible reservoir having a membrane, end well, or other end closure means for confining the leading end of a stack on the second path. The second conveyor means could comprise more than one reservoir, each with its own end closure means. For example, the second path could include separate interconnected reservoirs lying one above the other.

The first and second conveyor means preferably convey the articles in deeper stacks than normal on the first and second paths respectively, thereby providing longer conveyance time and greater storage capacity in a shorter overall conveyor length. Other parts of the first and second conveyor means, e.g. the part interconnecting the first and second paths, may be arranged to convey the articles in stacks of normal height, so that there is a transition between normal and deep stacks in at least one of the first and second conveyor means.

The inlet may be arranged for connection to a stack elevator or other means for delivering filter rods from a filter rod making machine, and the outlet may be arranged to supply rods to a pneumatic filter rod distributor unit. The speed of the first conveyor means (which, in this arrangement, becomes the delay line) is normally determined by the rate of supply of the stack from the filter rod making machine. The second conveyor means (the reservoir) is then preferably controlled by a sensor located adjacent the junction to adjust the flow to the outlet according to the demand of the distribution unit. If the junction is remote from the outlet an additional sensor may be required at the outlet. Where the junction is adjacent the inlet control of the first conveyor means (the delay line) may be in accordance with demand from the distribution unit, with fine control by means of a sensor located adjacent the outlet. Control of the second conveyor means (the reservoir) is then in accordance with the difference between supply from the making machine and demand of the distribution unit, with fine control by means of a sensor located adjacent the junction. The supply of rods to or from the second conveyor means (reservoir) adjusts the net flow through the first conveyor means (delay line).

The arrangement of the apparatus with the delay line of the first path and reservoir of the second path in horizontally spaced positions allows a compact construction occupying little floor space, especially where each of the first and second paths includes interconnected horizontal portions lying one above the other. It also allows the use of common shaft assemblies and provides a convenient position between the paths for mounting of the control and drive components of the apparatus.

The invention will now be further described, by way of example only, with reference to the accompanying diagrammatic drawings, in which.

Figure 1:
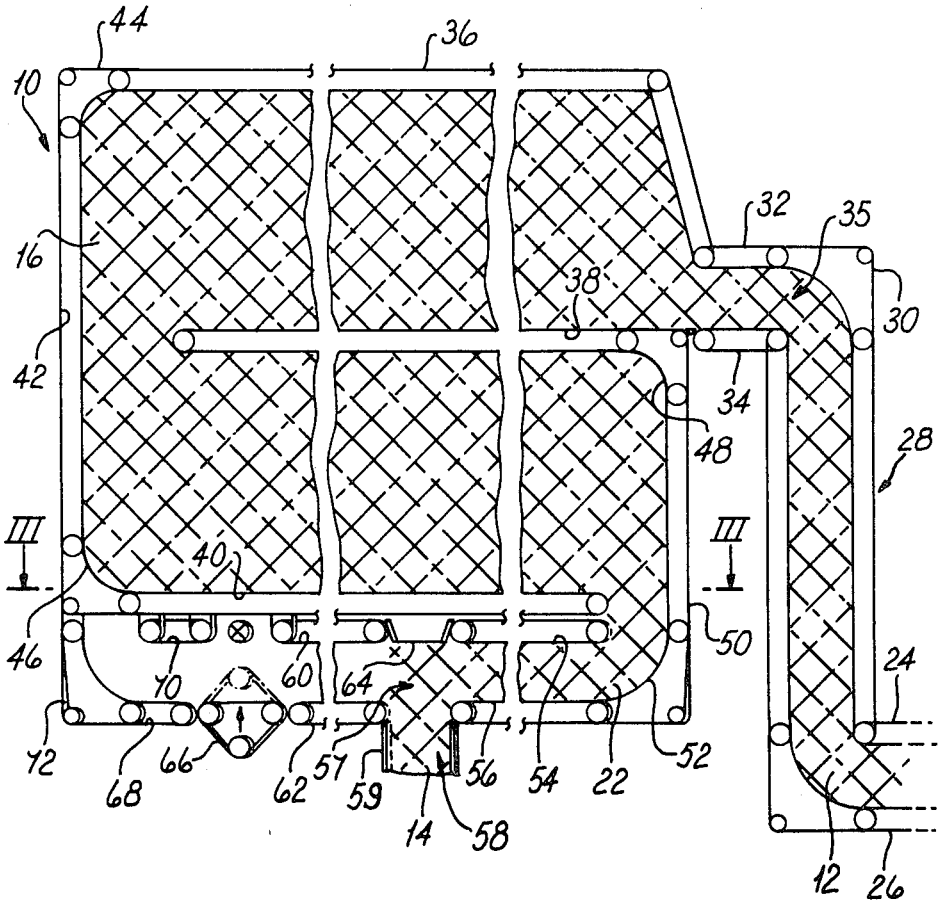
FIG. 1 is a side view of apparatus for conveying filter rods.
Figure 2:
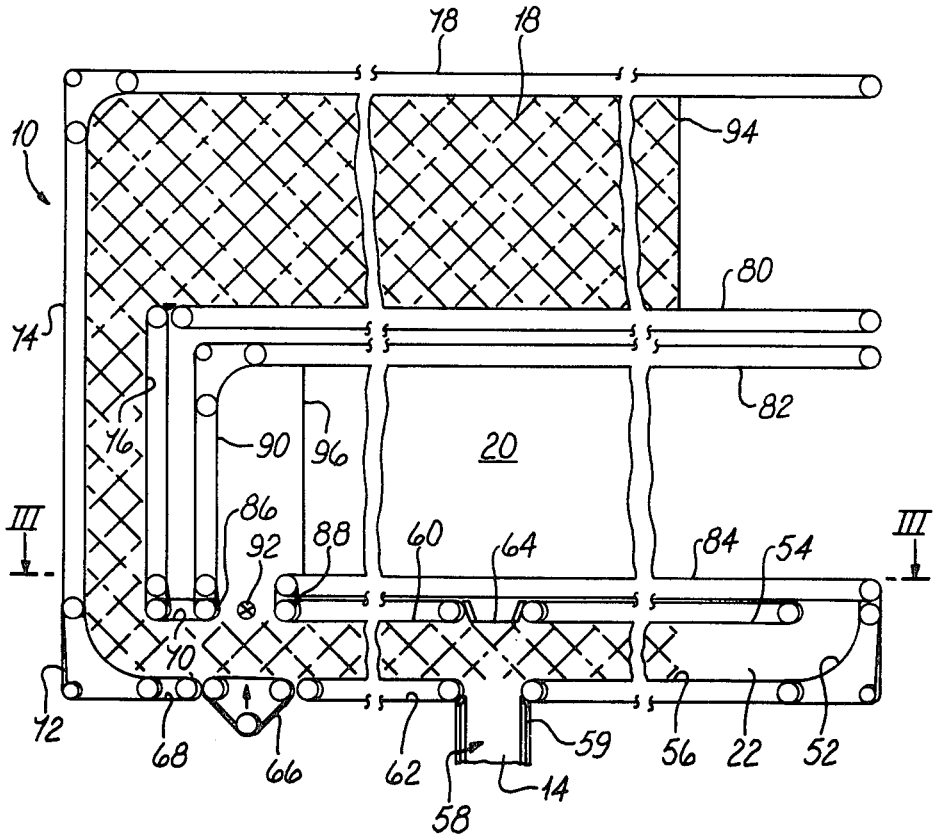
FIG. 2 is a view of the apparatus of FIG. 1 from the other side.
Figure 3:
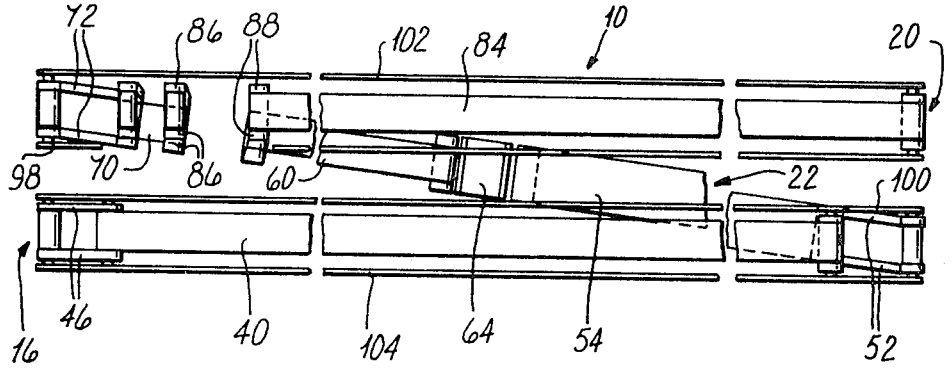
FIG. 3 is a view on the line III—III in FIGS. 1 and 2.

FIGS. 1 to 3 show conveying apparatus 10 arranged to receive a continuous stack 12 of filter rods from a filter rod making machine (e.g. Molins PM5) and deliver a stack 14 either directly to a filter cigarette making machine (e.g. Molins PA8) or, more usually, to pneumatic rod conveying apparatus (e.g. Molins APHIS) which delivers filter rods to several such machines.

The apparatus 10 includes a delay line 16, in which the rods are conveyed between the stacks 12 and 14 in a deep stack at a relatively slow rate, thereby allowing extended curing time for the rods where necessary, and also a reversible reservoir having upper and lower sections 18, 20 respectively, for accommodating short-term differences between supply of the stack 12 and demand for the stack 14. As can be seen by reference to FIG. 3, the delay line 16 and reservoirs 18, 20 are disposed alongside each other in horizontally-spaced vertical planes and are connected by a lower diagonal path 22 from which the stack 14 descends.

The stack 22 is formed from the single row output of the catcher drum of the filter rod making machine and is conveyed between bands 24, 26 to a stack elevator 28. The stack former and stack elevator may be as described in British Patent Specification No. 1,453,191 or U.S. patent application Ser. No. 859,708, to each of which reference is directed in its entirety. At the upper end of the elevator 28 the stack is passed via corner bands 30 and upper and lower bands 32, 34 into the inlet 35 of the delay line 16.

The first part of the delay line 16 consists of upper and lower bands 36, 38, which are at a greater spacing than the bands 32, 34 and convey the stack at a proportionally lower speed. The bands 36, 38 define an upper run of the delay line 16 which leads to a lower run defined between bands 38 and 40. The transition between the upper and lower runs is aided by a vertical band 42 and corner bands 44 and 46. The lower run extends beneath the upper run and terminates with corner bands 48 and vertical band 50, which direct the rods onto the diagonal path 22, the first part of which comprises corner bands 52 and upper and lower bands 54 and 56.

The bands 24, 26, 32, 34, 36, 38, 40, 42, 50, 54 and 56 are preferably formed with spaced ribs, which may correspond in cross-section to half a rod, as described in British Patent Specification No. 1,540,831 alternatively these bands may be formed with recesses of similar cross-section, as disclosed in said Application, or they may be formed with projections as described in British Patent Specification No. 1,453,191. In order to prevent possible damage to rods from the ribbed bands the pulleys for these bands may be provided with flanges to guide rods away from the vicinity of the pulleys, as disclosed in said Specification No. 1,453,191.

The corner bands 30, 44, 46, 48, 52 are preferably laterally spaced plain bands passing outside the ribbed bands where their pulleys are coaxial. The corner bands are also preferably provided with a curved backing plate. Suitable arrangements for the corner bands are disclosed in British Patent Specification No. 1,491,031 or U.S. Pat. No. 4,201,507 or U.S. patent application Ser. No. 859,708.

In passing from the delay line 16 onto the diagonal path 22 the rods are turned through a small angle about a transverse axis. The dimensions of the apparatus 10 are such that the angle is sufficiently small (e.g. about 6°) to create little difficulty, either in the transfer of rods or in the drive to the bands 52, 54, 56. However, it may be noted that, instead of a diagonal path 22, a path which is parallel to the delay line 16 and reservoir 18, 20 at its ends could be provided using laterally flexible conveyors, as disclosed in British Patent Specification No. 1,309,071 for example.

The stack on the diagonal path 22 is conveyed by the bands 54, 56 to a T-junction 57, from which the stack 14 descends through outlet 58 and chute 59. The other arm of the T-junction 57 is formed by further diagonal bands 60, 62, which lead towards the reservoir 18, 20. The speed and direction of movement of the bands 60, 62 (and hence the reservoir 18, 20) are controlled by means of a sensor 64 located above the T-junction 57. Delivery of the stack 14 is therefore controlled at least partly by the sensor 64, and this will respond to changes in demand from the downstream apparatus (e.g. pneumatic rod conveying apparatus) and to the rate of supply of articles through the delay line 16. In practice, the delay line 16 is normally controlled directly by the upstream apparatus, i.e. so that the rate of flow of rods through the delay line is related to the rate of supply of the stack 12. The sensor 64 could be of the type disclosed in British Patent Specification Nos. 1,372,148 or 1,529,961.

Beyond the bands 60, 62 the diagonal path 22 includes a lower band assembly 66 and bands 68, 70. The band 70 is spaced from the band 60 to define the entrance to the lower reservoir section 20. Corner bands 72 lead into an elevator defined between bands 74, 76 and redirect the stack into a path lying parallel to that of the delay line 16. The elevator leads into the upper reservoir section 18 having horizontal bands 78,80. The lower reservoir section 20 is defined by horizontal bands 82, 84 and extends from the entrance above diagonal path 22 by way of bands 86, 88, and 90. A photocell detector 92 is positioned at the entrance to the lower reservoir section 20. Since bands 86 and 88 pass from the diagonal path 22 into the plane of the reservoir 18, 20, some degree of twisting and lateral displacement of the rods passing between the path 22 and lower reservoir section 20 is necessary. In order to minimize the disturbance of the rods it may be advisable to extend bands 86 and 88 so that the lower reservoir section 20 is further above the path 22 than indicated in the drawings.

The bands 78, 80 and 82, 84 are provided with end walls 94, 96, respectively, each of which is movable with the bands, as disclosed in British Patent Specification No. 1,299,174, for example.

It will be appreciated that the conveyor bands and corner bands of the diagonal path 22 and reservoir 18, 20 may be constructed and arranged in the same way as already described with reference to the bands of the delay line 16.

In operation, the stack 12 passes into the apparatus 10 onto the delay line 16 via inlet 35, and along the diagonal path 22 to the outlet 58 and chute 59, which delivers the stack 14 to the downstream apparatus. The speed of passage of rods through the delay line 16 is determined in general by the rate of supply of the stack 12. In order to accommodate short term differences between supply of the stack 12 and demand for the stack 14, the reservoirs 18, 20 may be operated under control of the sensor 64. Assuming conditions are such that supply exceeds demand the bands 60, 62 are driven to remove rods from the T-junction 57 and rods are supplied to the upper reservoir section 18 by way of elevator bands 74, 76 and horizontal bands 78, 80, the end wall 94 moving with the bands 78, 80 to progressively fill the section 18. When the upper reservoir section 18 is full the end wall 94 actuates a microswitch which brings into operation the lower reservoir section 20.

In order to start filling the lower reservoir section 20 it is necessary to move rods upwards from the diagonal path 22 between the bands 86, 88. This is achieved by moving the center pulley of the band assembly 66 upwards, into the position indicated in chain-dotted lines in FIG. 1, so that rods are lifted towards the bands 86, 88 and the stack approaching along the diagonal path 22 is directed into the entrance to the lower reservoir section 20. Subsequently the bands 82, 84 and end wall 96 retreat from the position shown in FIG. 2 and the section 20 is progressively filled. If the end wall 96 reaches its end stop, so that the reservoir 18, 20 is full, the supply of stack 12 may be automatically stopped.

As a refinement, when the lower section 20 becomes half full, so that the reservoir 18, 20 is three-quarters full the speed of the stack 12 may be reduced to three-quarters or half its normal value.

Assuming now that demand for the stack 14 exceeds supply of the stack 12 it will be necessary to supplement the flow from the delay line 16 with rods from the reservoir 18, 20. Assuming also that the lower reservoir section 20 is partly filled (the upper reservoir section 18 will therefore be full), the end wall 96 is progressively moved to the left as seen in FIG. 2 and rods are delivered downwards between bands 86, 88. The band assembly 66 preferably remains in its loading position with the center pulley raised, and the stack unloaded by the lower reservoir section 20 is passed by bands 60, 62 to the T-junction 57 above outlet 58. When the lower reservoir section 20 is empty, as detected by photocell 92, the center pulley of band assembly 66 is lowered and unloading of the upper reservoir section 18 starts. When both upper and lower reservoir sections 18, 20 are empty, and if demand still exceeds supply, the downstream apparatus is automatically stopped.

Although it is preferable to load and unload the upper and lower reservoir sections 18, 20 in sequence it would be possible to load or unload the sections simultaneously.

Referring now in particular to FIG. 3, the apparatus 10 has an inner frame having substantially vertical plates 98, 100 which support the drive mechanism (not shown) for the various bands, and also the inner ends of the pulleys of the delay line 16 and reservoir 18, 20. The outer ends of these pulleys are carried by outer plates 102, 104. In a preferred modification the pulleys are carried on common spindles which span the gap between plates 98, 100 and are not supported at their outer ends. The plates 102, 104 may then be replaced by doors, which may be made from transparent plastics material.

The delay line 16 may comprise more than two sections and could have a zig-zag path similar to that of the reservoir disclosed in British Patent Specification No. 1,491,031. Similarly there may be more than two reservoir sections, or the reservoir could have a zig-zag path, possibly with a lower stack height, similar to that disclosed in said Specification. The upper and lower sections of the delay line and the upper and lower sections of the reservoir are respectively at substantially the same levels: this is not essential although it aids the use of common spindles for the band pulleys.

Typically the apparatus 10 may be about 3500 mm long with a stack height of 400 mm in the delay line 16 and reservoir 18, 20. This gives a capacity of about 45,000 to 50,000 rods in the delay line and in the reservoir. The height or width of the stacks 12, 14 are typically 90–100 mm.

Figure 4:
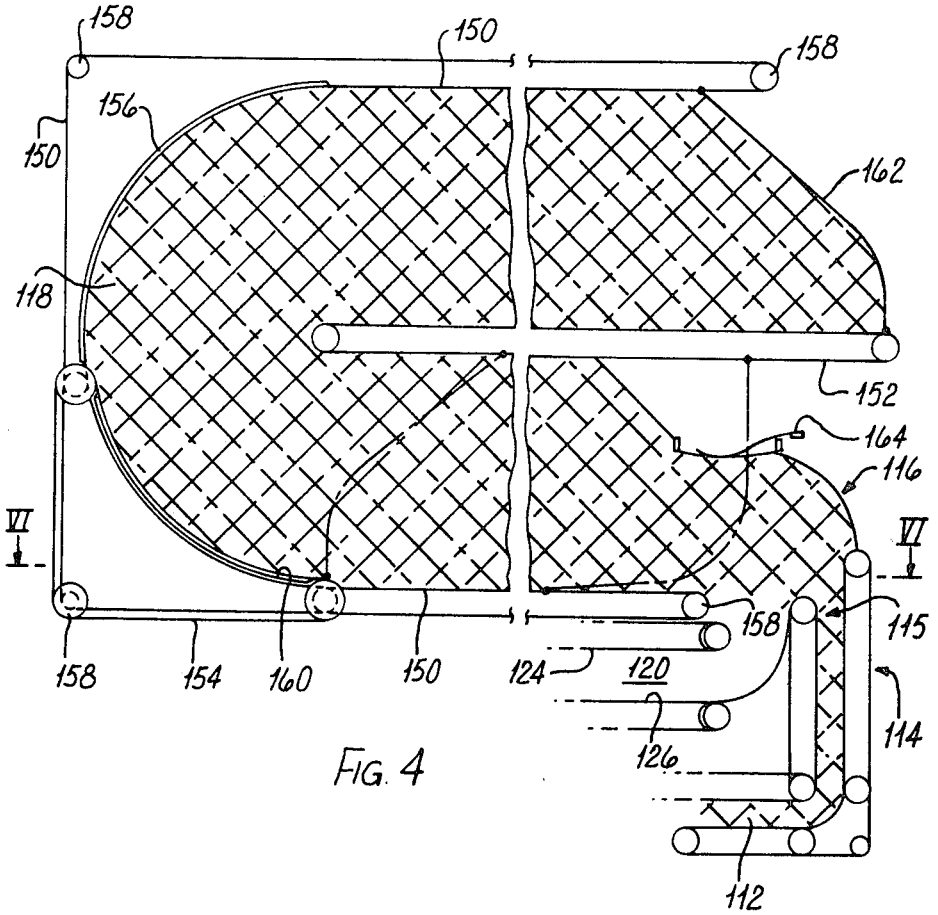
FIG. 4 is a side view of further apparatus for conveying filter rods.
Figure 5:
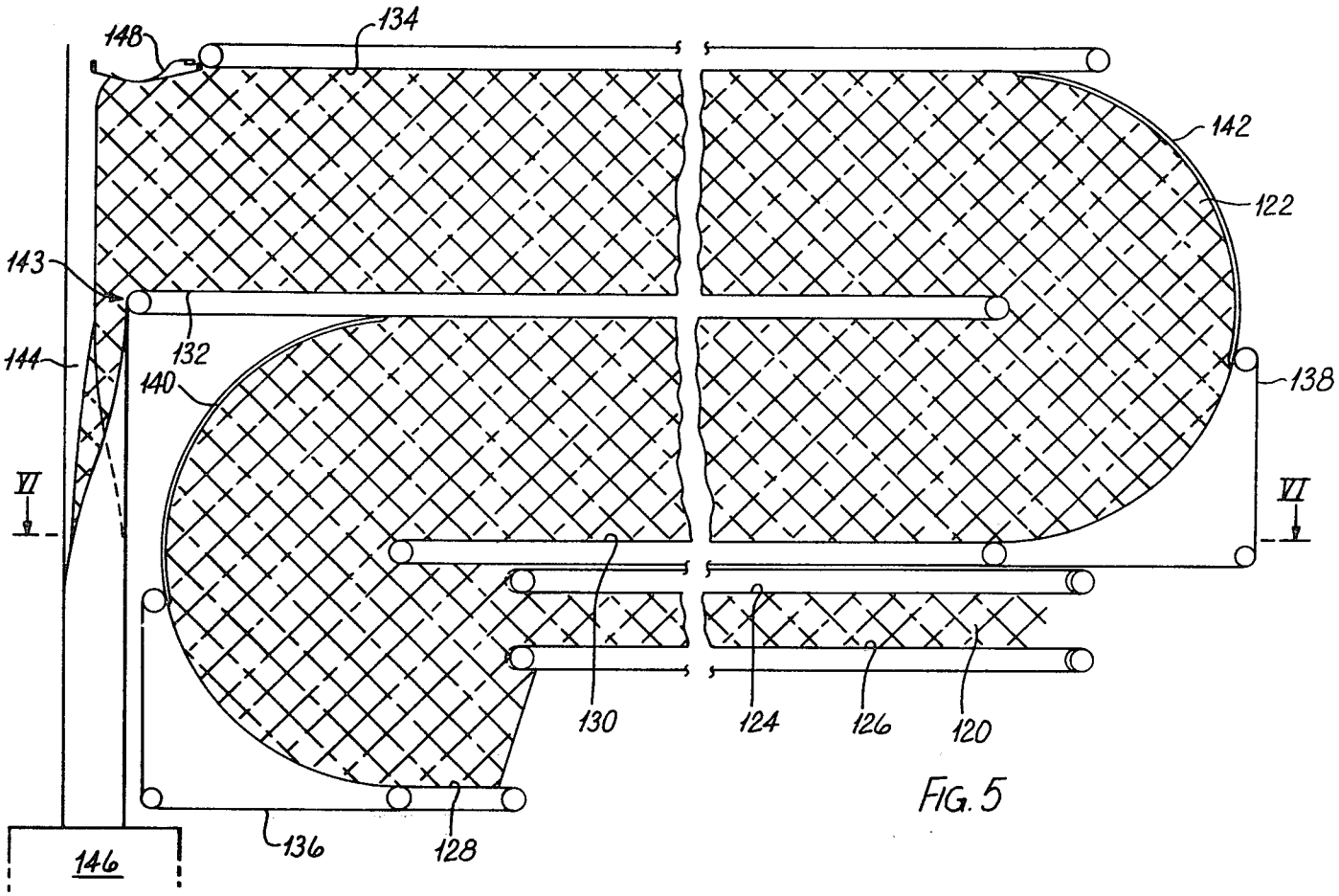
FIG. 5 is a view of the apparatus of FIG. 4 from the other side.
Figure 6:
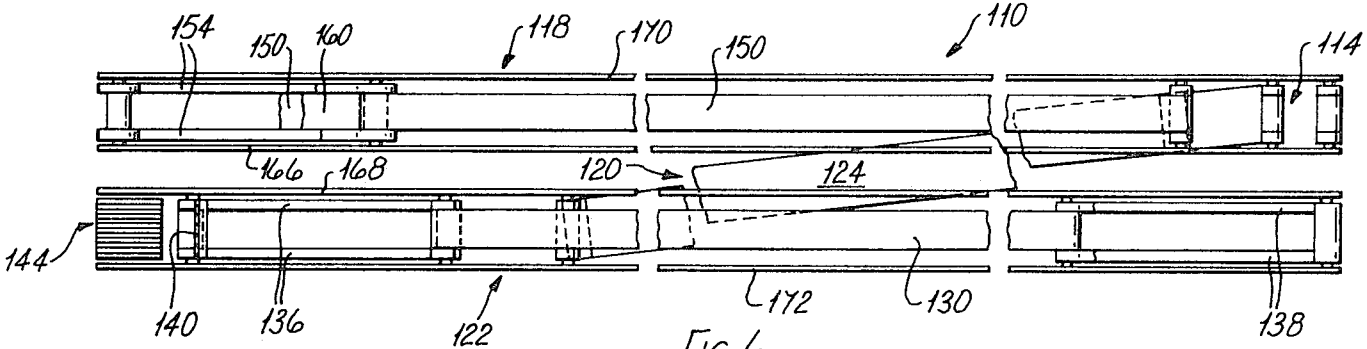
FIG. 6 is a view on the line VI—VI in FIGS. 4 and 5.

FIGS. 4 to 6 show apparatus 110 which may be used for the same purpose as the apparatus 10 of FIGS. 1 to 3. A stack of filter rods is delivered from a filter rod making machine to a stack elevator 114 which leads to an inlet 115 and junction 116. The elevator 114 may be the same as the elevator 28. Alternatively a single row may be fed directly from the filter rod making machine to the junction 116 along a path including a single row elevator such as that disclosed in British Patent Specification No. 1,299,174.

From the junction 116 the flow of rods splits, passing either to a reservoir 118 or down onto a diagonal path 120 leading to a delay line 122. The diagonal path 120 is inclined at a small angle (about 6°) to the plane of movement of the rods in the junction 116 and reservoir 118 and is defined between horizontal bands 124, 126. As shown in FIGS. 5 and 6 the path 120 leads to the delay line 122, which lies alongside the reservoir 118 in a horizontally spaced vertical plane and which conveys a much deeper stack than the stack on path 120.

The delay line 122 is generally S-shaped and comprises horizontal bands 128, 130, 132, 134, corner bands 136, 138, and curved guides 140, 142. At the end of the delay line 122 the bands 132, 134 deliver the rods into an outlet 143 and chute 144 leading down into a pneumatic rod conveyor unit 146. A sensor 148 of the type described in British Patent Specification No. 1,372,148 is located above the chute 144. The chute is twisted so that the rods are correctly orientated for entry into the unit 146.

Referring back to FIG. 4, the reservoir 118 extending from the junction 116 is generally C-shaped and comprises an outer band 150, an inner band 152, corner bands 154, and a curved guide 156. The outer band passes around four pulleys 158 and passes behind the guide 156 and a curved backing plate 160 for the corner bands 154. A flexible membrane 162 is attached to the outer and inner bands 150, 152. A sensor 164, of similar construction to the sensor 148, is located over the junction 116.

The bands 124, 126, 130, 132, 134, 150, 152 are preferably ribbed bands and may be of similar construction to the bands 24 etc., of the apparatus 10. Similarly the corner bands 136, 138, 154 may be like the bands 30 etc. The corners in the reservoir 118 and delay line 122 could be modified in accordance with any of the arrangements referred to in relation to the apparatus 10. In particular the curved guides 140, 142, 156 could be replaced by corner bands, for example as disclosed in British Patent Specification No. 1,491,031.

In operation of the apparatus 110 with the reservoir 118 stationary the stack 112 flows from the junction 116 along path 120 into the delay line 122. Flow through the delay line 122 is controlled by a signal derived from the unit 146 according to its demand for rods with fine control provided by the sensor 148 over outlet 143 and chute 144. Passage of the stack around the corners of the delay line 122 is smoothest if the the corner bands 136, 138 are run at twice the speed of the bands 128, 130, 132, 134.

Operation of the reservoir 118 is controlled by the difference signal derived from the demand signal of unit 146 and a supply signal proportional to the rate of supply of stack 112, with fine control provided by the sensor 164 over the junction 116. The rods at the leading end of the reservoir 118 are supported by the flexible membrane 162 which is elastically attached to the outer and inner bands 150, 152. One or more slots are provided in the plate 160 and guide 156 to allow passage of the connections to the membrane 162 as the band 150 passes behind the plate and guide. The connections of the membrane 162 to the respective bands 150, 152 are such that they are in line horizontally at the mid-point of the bend. As shown in FIG. 4 the reservoir 118 is substantially full: the position of the membrane when the reservoir is in other states of fill is indicated in chain-dotted lines.

It is possible that the membrane 162 could be replaced by an end closure device such as that disclosed in British Patent Specification No. 1,491,031 or in U.S. patent application Ser. No. 786,493.

As with the delay line 122 it is preferred to run the corner bands 154 at twice the speed of the bands 150, 152 when the rods are moving upwards around the bend. However, in the reversible reservoir 118, the rods also have to be moved downwards around the bend and it is then preferable for the corner bands 154 and bands 150, 152 to run at the same speed. A change speed mechanism may be provided in the drive to provide automatic change on reversal.

The reservoir 118 may include switching means which reduces supply of the stream 112 to three-quarters normal speed when the reservoir reaches three-quarters capacity and may stop supply when it is full. Similarly if the reservoir 118 reaches the empty position then unit 146 may be automatically stopped.

The layout of the apparatus 110, with the reservoir 118 alongside the delay line 122 is best seen in FIG. 6. The apparatus includes vertical frame members 166, 168 between which extend spindles for the pulleys, many of the spindles being common for pulleys in the delay line 122 and reservoir 118. The drive gear for the pulleys is also mounted between the plates 166, 168. Doors 170, 172 (e.g. of transport plastics material) are provided for the reservoir 118 and delay line 122, respectively.

Instead of being merely C-shaped or S-shaped the reservoir 118 and delay line 122 could comprise zig-zag arrangements of conveyors, similar to the arrangement disclosed in British Patent Specification No. 1,491,031. The stacks need not be conveyed in the delay line and reservoir at the same levels.

Typical dimensions for the apparatus 110 are 4000 mm long, 2600 mm high and 440 mm wide. The height of the deep stacks in the reservoir 118 and delay line 122 is up to about 400 mm., whereas the "normal" stack on the diagonal path 122 is about 100 mm deep and that in the chute 144 about 90 mm wide. Filter rods ranging in length from 66 to 160 mm and in diameter from 6 to 9 mm can be handled by the apparatus. This gives a capacity of around 57,000 filter rods in the delay line and 46,000 rods in the reservoir.

Figure 8:
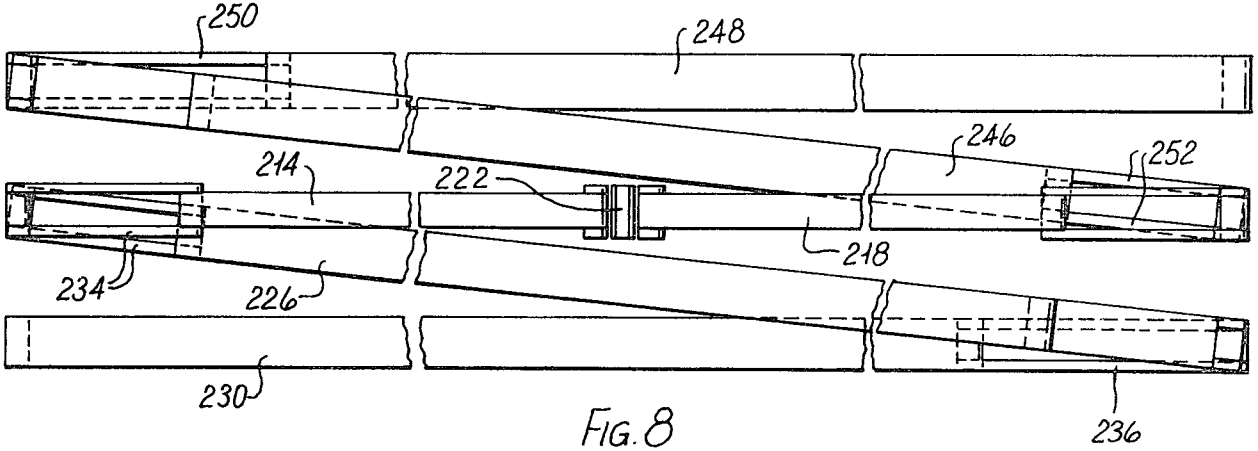
FIG. 8 is a view on the line VIII—VIII in FIG. 7.
Figure 7:
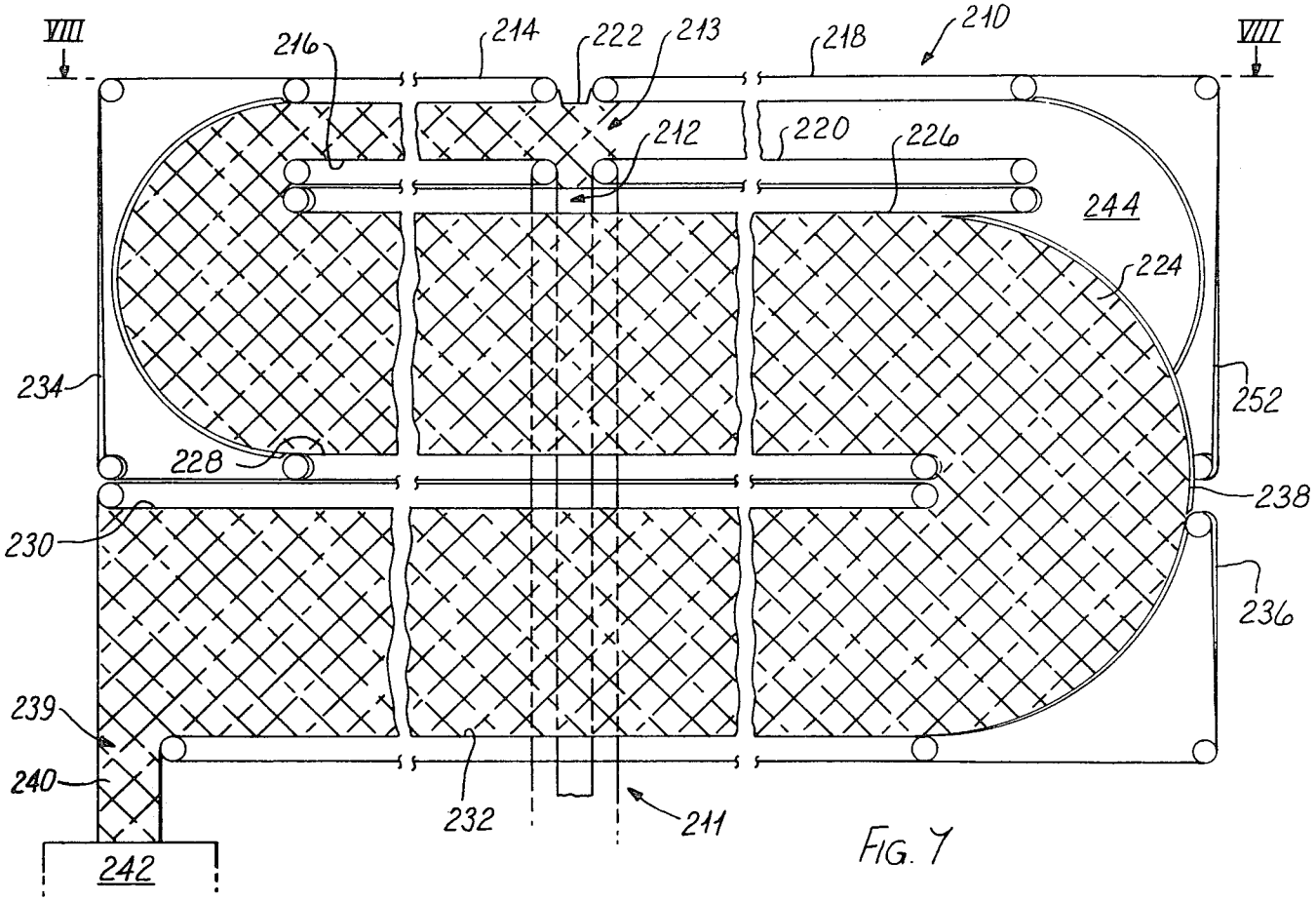
FIG. 7 is a side view of still further apparatus for conveying filter rods.

FIGS. 7 and 8 show further apparatus 210 which is usable in basically the same way as the apparatus 10 or 110. Filter rods are moved in stack formation up a central elevator 211, which may be similar to the elevator 28 or 114, through an inlet 212 to a T-junction 213 with upper band conveyors 214, 216 and 218, 220. A sensor 222 is located over the T-junction 213. The conveyors 214, 216 lead into a delay line 224, which comprises bands 226, 228, 230, 232, corner bands 234, 236, and curved guide 238. As best seen by reference to FIG. 8 the bands 214, 216 and 230, 232 are parallel with the bands 226, 228 extending diagonally across between them. The delay line 224 terminates at an outlet 239 and a chute 240 leading into a pneumatic rod distributor unit 242.

On the other side of the T-junction 213 at the top of elevator 211 the bands 218, 220 lead into a reservoir 244 having a downward S-shaped path similar to that of the delay line 224 but on the other side of the apparatus 210. The reservoir 244 includes bands 246, 248 and corner bands 250, 252. The reservoir 244 is reversible and the leading rods are supported by a membrane or other end closure device such as that disclosed in British Patent Specification No. 1,299,174 or U.S. Pat. No. 4,201,507.

Instead of conveying a deep stack the reservoir 244 could carry a stack of normal height around two or more corners of a zig-zag path, as disclosed in said Specification No. 1,491,031.

Construction and arrangement of the various bands in the apparatus 210 may be similar to that described or referred to in relation to the bands in the apparatus 10 or 110. Operation of the apparatus 210 is analogous to that of the apparatus 10 or 110, the rods being passed from the elevator 211 to the unit 242 via the delay line 224, with reversible operation of the reservoir 244 according to the difference between supply and demand as detected by means of sensor 222.

We claim:

1. Apparatus for conveying rod-like articles, including an inlet for rod-like articles; an outlet for rod-like articles; first conveyor means for moving a stack of said articles unidirectionally from the inlet to the outlet; second conveyor means for moving a stack of said articles to and from a junction with the first conveyor means, said first and second conveyor means respectively defining first and second paths having major portions at least which respectively extend in adjacent laterally-spaced, substantially-vertically planes and are disposed generally side-by-side with respect to each other.

2. Apparatus as claimed in claim 1, wherein at least one of said paths includes a plurality of interconnected substantially horizontal paths lying in vertically-spaced planes.

3. Apparatus as claimed in claim 2, wherein at least one of said conveyor means includes a conveyor section which forms at least part of a connecting path which extends laterally between the first and second paths.

4. Apparatus as claimed in claim 3, wherein the junction is located on or adjacent the connecting path.

5. Apparatus as claimed in claim 4, wherein the outlet is located on or adjacent the connecting path.

6. Apparatus as claimed in claim 4, wherein the inlet is located on or adjacent the connecting path.

7. Apparatus as claimed in claim 1, wherein the second conveyor means comprises a reversible reservoir having movable end closure means for a stack of articles in the reservoir.

8. Apparatus as claimed in claim 7, wherein the second conveyor means comprises at least two separate interconnected reversible reservoirs.

9. Apparatus as claimed in claim 1, wherein at least one of said first and second conveyor means includes sections for conveying stacks of different heights.

10. Apparatus as claimed in claim 9, wherein articles are conveyed in a stream of lower height adjacent the junction.

11. Apparatus as claimed in claim 1, including a sensor located adjacent the junction and connected to at least partly control operation of the second conveyor means.

12. Apparatus as claimed in claim 1 or claim 11, including a sensor located adjacent the outlet and connected to at least partly control operation of the first conveyor means.

13. Apparatus for conveying rod-like articles, including an inlet connectable to an article producing machine and an outlet connectable to an article receiving machine; first conveyor means for moving articles unidirectionally in stack formation from said inlet to said outlet; a junction in said first conveyor means; reversible second conveyor means for moving articles in stack formation to and from said junction, said second conveyor means including end closure means for retaining the end of a stack of articles conveyed by said second conveyor means; said first and second conveyor means respectively defining first and second paths having major portions at least which respectively extend in adjacent laterally-spaced, substantially-vertical planes and are disposed generally side-by-side with respect to each other; and a sensor located adjacent the junction and connected to at least partly control operation of the second conveyor means.

14. Apparatus as claimed in claim 13, including a connecting path extending laterally between said first and second paths, said junction and one of said inlet and said outlet being located on or adjacent said connecting path.

15. Apparatus as claimed in claim 14, wherein said connecting path is adapted to convey articles in a stack having a depth which is less than that of the stacks in at least part of the first and second conveying means.

16. Apparatus for conveying rod-like articles, including an inlet for a stack of rod-like articles; an outlet for a stack of rod-like articles; first endless conveyor means for conveying a stack of articles unidirectionally from the inlet to the outlet, said conveyor means including means to convey a stack of greater height than that of the stacks at said inlet and said outlet; second endless conveyor means for reversibly moving a stack of articles to and from a junction with said first endless conveyor means; said first and second conveyor means respectively including parts which are disposed alongside one another.

17. Apparatus for conveying rod-like articles including an inlet for a stack of rod-like articles; an outlet for a stack of rod-like articles; first conveyor means for moving a stack of said articles unidirectionally from the inlet to the outlet, said conveyor means including means at a first transition zone by which a stack delivered from said inlet is increased in height and means at a second transition zone by which said stack is reduced in height for delivery to said outlet; and second conveyor means for moving a stack of said articles to and from a junction with the first conveyor means, the first and second conveyor means respectively including adjacent portions which extend in adjacent laterally-spaced, substantially-vertical planes and are disposed generally side-by-side with respect to each other.

18. Apparatus for conveying rod-like articles, including an inlet for rod-like articles; an outlet for rod-like articles; first conveyor means for moving a stack of said articles unidirectionally from the inlet to the outlet; and second conveyor means for moving a stack of articles to and from a junction with said first conveyor means, said second conveyor means including a substantially-horizontal conveyor section, first and second elevators leading from said conveyor section, and first and second substantially-horizontal endless conveyors respectively connected to said first and second elevators and arranged in vertically-spaced planes.

19. Apparatus as claimed in claim 18, wherein said first conveyor means includes at least two interconnected substantially-horizontal, vertically-spaced conveyor sections disposed in a vertical plane which is horizontally spaced from a plane containing said horizontal conveyors of said second conveyor means.

20. Apparatus for conveying rod-like articles in stack formation, including first endless conveyor means defining a first path having at least two substantially-horizontal conveyor sections connected in series for unidirectional passage of articles along said path towards an outlet, said sections being disposed and interconnected in a first substantially-vertical plane, second endless conveyor means defining a reversible second path having a junction with said first path and including at least two substantially-horizontal sections disposed and interconnected in a second substantially-vertical plane which is adjacent to and disposed alongside said first plane; and means for reversibly moving said second endless conveyor means to modify the flow of articles through said first endless conveyor means.

21. Apparatus as claimed in claim 20, wherein said horizontal sections of said second conveyor means are connected in series.

22. Apparatus as claimed in claim 20, wherein said horizontal sections of said second conveyor means are connected in parallel.

* * * * *